US007228856B2

(12) United States Patent
Aoyagi

(10) Patent No.: US 7,228,856 B2
(45) Date of Patent: Jun. 12, 2007

(54) DIAMOND CUTTING METHOD AND DIAMOND PROVIDED BY THE METHOD

(75) Inventor: Takeshi Aoyagi, Tokyo (JP)

(73) Assignee: Tokyo Shinzyu Co., Ltd. (JP)

( * ) Notice: Subject to any disclaimer, the term of this patent is extended or adjusted under 35 U.S.C. 154(b) by 0 days.

(21) Appl. No.: 10/543,320

(22) PCT Filed: Feb. 12, 2004

(86) PCT No.: PCT/JP2004/001509

§ 371 (c)(1),
(2), (4) Date: Jul. 25, 2005

(87) PCT Pub. No.: WO2004/071735

PCT Pub. Date: Aug. 26, 2004

(65) Prior Publication Data

US 2006/0137674 A1 Jun. 29, 2006

(30) Foreign Application Priority Data

Feb. 13, 2003 (JP) ..... 2003-035665

(51) Int. Cl.
*B28D 5/00* (2006.01)

(52) U.S. Cl. ..... 125/30.01; 63/32

(58) Field of Classification Search ..... 125/30.01; 29/896.4, 10; 63/32; 264/DIG. 55; D11/89–92
See application file for complete search history.

(56) References Cited

U.S. PATENT DOCUMENTS

| | | | | | |
|---|---|---|---|---|---|
| 141,259 | A * | 7/1873 | Fine | 81/57.3 |
| 3,585,764 | A * | 6/1971 | Huisman et al. | 451/58 |
| 3,650,074 | A * | 3/1972 | Weinz | 451/11 |
| 4,083,352 | A * | 4/1978 | Andrychuk | 63/32 |
| 5,072,549 | A * | 12/1991 | Johnston | 451/41 |
| 5,462,474 | A * | 10/1995 | Hansen | 451/41 |
| 6,604,382 | B2 * | 8/2003 | Shuto | 63/32 |
| 6,615,611 | B1 * | 9/2003 | Schachter et al. | 63/32 |
| 6,668,585 | B1 * | 12/2003 | Markowitz | 63/32 |
| 6,892,720 | B2 * | 5/2005 | Schachter et al. | 125/30.01 |
| 2003/0154741 | A1 * | 8/2003 | Kawabuchi et al. | 63/32 |

* cited by examiner

*Primary Examiner*—Joseph J. Hall, III
*Assistant Examiner*—Robert Scruggs
(74) *Attorney, Agent, or Firm*—James E. Walton

(57) ABSTRACT

Ten of pavilion main facets are formed with reference to the previously formed five of first pavilion main facets in which an initial first main facet is formed in a position centered on a line shifted approximately fifteen degrees from the ridge of the raw diamond on the pavilion side. Ten of pavilion main facets 19 radiate from the curette 18 and twenty of lower girdle facets are formed between the adjacent pavilion main facets on the pavilion side of the diamond 1.

19 Claims, 12 Drawing Sheets

DIAMOND CUTTING METHOD AND DIAMOND PROVIDED BY THE METHOD

BACKGROUND OF THE INVENTION

This application is a U.S. National-Stage application under 35 U.S.C. § 371 of International Application No. PCT/JP2004/001509, having an International Filing Date of 12 Feb. 2004, which claims priority to Japanese Patent Application No. 2003-035665, filed on 13 Feb. 2003, both of which are incorporated by reference herein.

The present invention relates to a method of cutting diamond for providing a diamond with a strong brilliance and diamonds obtained thereby, and more particularly to a method of cutting diamond in which ten, which is considerable number in comparison with conventional diamonds, projections of heart and allow are observed under a predetermined lighting condition.

Conventionally, a diamond comprises a generally trapezoidal conic crown having a flat table on top, a generally conic pavilion having an acute curette, and a strip-like girdle provided on the lateral surface along the boundary of the crown and the pavilion. A conventional diamond is commonly cut in order to form a table 81, eight crown main facets 82, eight star facets, and sixteen upper girdle facets 84 on the crown side and eight pavilion main facets 85 and sixteen lower girdle facets 86 on the pavilion side by a method called 'round brilliant cut' as shown in FIGS. 11 and 12.

For applying a polishing process on the pavilion side by the above-mentioned method, for example, one of ridges 91 of raw diamond 3 in crystal form shown in FIGS. 8(*a*) and 13(*a*) is flatten and a first pavilion main facet 92 centered on the ridge 91 (refer to FIG. 13(*b*)) is formed as a first step. Subsequently, three other ridges 91 are flatten in a similar manner as mentioned above and four pavilion main facets 92 are formed altogether as shown in FIG. 13(*c*). In the event as mentioned above, four first pavilion main facets 92 are formed and therefore each of the central angles 95 of the main facets 92 becomes ninety degrees. Thereafter, the boundary line 93 formed between two adjacent first pavilion main facets is flatten by polishing and eight pavilion main facets 94 centered on the ridges 91 with the central angles of forty five degrees are formed as a second step.

On the other hand, in the event of applying a polishing process on the crown side, a top portion of the raw diamond in crystal form is cut off in order to form a flat table 103 thereon as shown in FIGS. 8(*b*) and 14(*a*). A first crown main facet 104 is formed by polishing a portion centered on a ridge 101 in the raw diamond 3 in crystal form flat and three other pavilion main facets 104 are formed subsequently, which totals to four pavilion main facets as a first step (refer to FIGS. 14(*b*) and 14(*c*)). In the event as mentioned above, each boundary line 105 of two adjacent first crown main facets 104 meets the next boundary line with an angle 108 of ninety degrees in relation to a center point. Thereafter, eight of second crown main facets 107 having central angles 109 of forty-five degrees are formed by polishing portions centered on the boundary lines 105 as a second step.

Incidentally, a device called tang 54 for holding the raw diamond 3 and a scaif 51 formed of a flat steel plate strewed with diamond powder are used in the polishing process as mentioned above. The raw diamond 3 is held by the tang 54 capable of changing the angle at forty-five degrees and polished by the rotating surface of the scaif 51 as shown in FIG. 10.

And it is empirically known that a heart and allow phenomenon may be observed in a diamond in an excellent proportion among the diamonds processed as mentioned above by using a magnifying device when one of the main facets of the diamond is illuminated by the light colored through a color filter and the remainder are shielded from incident light. The heart and allow phenomenon is one of the strongest selling point as a proof of excellence in brilliance of the diamond. When a diamond finished in round brilliant cut is mounted in a face-up direction (having a table of a crown upward) under a predetermined lighting condition, eight of allow phenomenon 123 projecting over the surface may be observed as shown in FIG. 15. And when the above-mentioned diamond is mounted in a face-down direction (having the table of the crown downward) under a predetermined lighting condition, eight of heart phenomenon 124 projecting over the surface may be observed as shown in FIG. 16.

Generally diamond is colorless but superior to other jewels in its brilliance. And it is understood that the brilliance caused by reflection called 'brilliancy', an iris called 'fire' for dispersing light like a prism, and flashes called 'scintillation'. Therefore, diamonds emitting a stronger brilliance are required.

SUMMARY OF THE INVENTION

In view of the above-mentioned facts, it is therefore an object of the present invention to provide a method of cutting diamond capable of emitting stronger brilliance and showing more heart and allow phenomenon than conventional diamonds finished in round brilliant cut and diamonds obtained thereby.

That is, a method of cutting diamond of the present invention for providing a diamond with a generally trapezoidal conic crown having a flat table on top, a generally conic pavilion having an acute curette at the center, and a strip-like girdle provided on the lateral surface along the boundary of the above-mentioned crown and the above-mentioned pavilion is characterized in comprising:

a first step of forming an initial first pavilion main facet centered on a line shifted approximately fifteen degrees from a ridge formed on the pavilion side of a raw diamond in crystal form and the remainder of the first pavilion main faces subsequently, which totals five of first pavilion main facets, and a second step of forming ten of second pavilion main facets centered on the boundary lines between the above-mentioned first pavilion main facets. And a method of cutting diamond of the present invention for providing a diamond with a generally trapezoidal conic crown having a flat table on top, a generally conic pavilion having an acute curette at the center, and a strip-like girdle provided on the lateral surface along the boundary of the above-mentioned crown and the above-mentioned pavilion is characterized in comprising:

a first step of forming an initial first crown main facet centered on a line shifted approximately fifteen degrees from a ridge formed on the crown side of the raw diamond in crystal form and the remainder of the first crown main faces subsequently, which totals five of first crown main facets, and a second step of forming ten of second crown main facets centered on the boundary lines between the above-mentioned first crown main facets.

Therefore, the method facilitates the process of forming ten of pavilion main facets and ten of crown main facets by polishing each facet centered on a line shifted approximately fifteen degrees from a ridge of the raw diamond in crystal form while getting clear of portions difficult to polish in the raw diamond.

The method of cutting diamond of the present invention claimed in claims 1 and 2 is characterized in using a device providing means for using a tang for changing the direction of the above-mentioned raw diamond held therein at a predetermined angle and means for applying a polishing process with respect to the above-mentioned raw diamond by rotating the scaif in the steps of forming the above-mentioned first and the second pavilion main facets and the above-mentioned first and the second crown main facets, in which the above-mentioned device applies a polishing process with respect to the above-mentioned raw diamond by chaining the direction of the above-mentioned raw diamond held therein at an angle of thirty-six degrees.

Therefore, ten of pavilion main facets and ten of crown main facets may be formed at a correct angle ratio.

The present invention is characterized in a diamond obtained by the cutting method as claimed in claims 1 through 3. And the diamond of the present invention is characterized in providing a generally trapezoidal conic crown having a flat table on top, a generally conic pavilion having an acute curette at the center, and a strip-like girdle provided on the lateral surface along the boundary of the above-mentioned crown and the above-mentioned pavilion, in which ten of pavilion main facets radiating from the above-mentioned curette and twenty of lower girdle facets formed between adjacent pavilion main facets are formed respectively on the above-mentioned pavilion side. And the diamond of the present invention is characterized in providing a generally trapezoidal conic crown having a flat table on top, a generally conic pavilion having an acute curette at the center, and a strip-like girdle provided on the lateral surface along the boundary of the above-mentioned crown and the above-mentioned pavilion, in which ten of star facets encircling the above-mentioned table, ten of crown main facets encircling the above-mentioned star facets, and twenty of upper girdle facets further encircling the above-mentioned crown main facets are formed on the above-mentioned crown side.

Further, the diamond of the present invention claimed in claims 1 through 6 is characterized in that a projection of ten heart shapes are observed when the above-mentioned diamond is mounted in face-down direction under a predetermined lighting condition. And the diamond of the present invention claimed in claims 1 through 6 is characterized in that a projection of ten allow shapes are observed when the above-mentioned diamond is mounted in face-up direction under the predetermined lighting condition.

Therefore, the diamond of the present invention is capable of embodying more heart and allow phenomenon as a proof of excellence of diamonds and emitting stronger brilliance.

It is generally thought that the more pavilion facet on the surface, the stronger a diamond emits brilliance. However, in the event that the pavilion main facets or the crown main facets are formed more than necessary, each shape in the heart and allow phenomenon which is a proof of excellence in cutting and brilliance gets too close to each other and may hardly be observed by the unaided eye. And in the event of increasing the pavilion main facets by using the conventional cutting method, polishing process may not proceed favorably in relation to the raw diamond in crystal form. From a assiduous study of problems mentioned above, the inventor of the present invention accomplished the present invention for cutting diamond in which the pavilion main facets and the crown main facets are increased as many as possible to the extent that the heart and allow phenomenon may be observed by the unaided eye.

It is therefore an object of the present invention to provide a diamond in which an initial first main facet is formed in a position centered on a line shifted approximately fifteen degrees from a ridge formed on the raw diamond in crystal form and the remainder of the first main facets are formed subsequently, which totals five of first pavilion main facets, and thereafter ten of second main facets centered on the boundary lines between the adjacent first main facets are formed on both pavilion side and crown side, thereby allowing the diamond to emit stronger brilliance and embody the heart and allow phenomenon observed by the unaided eye.

DETAILED DESCRIPTION OF THE PREFERRED EMBODIMENTS

Figure 1:
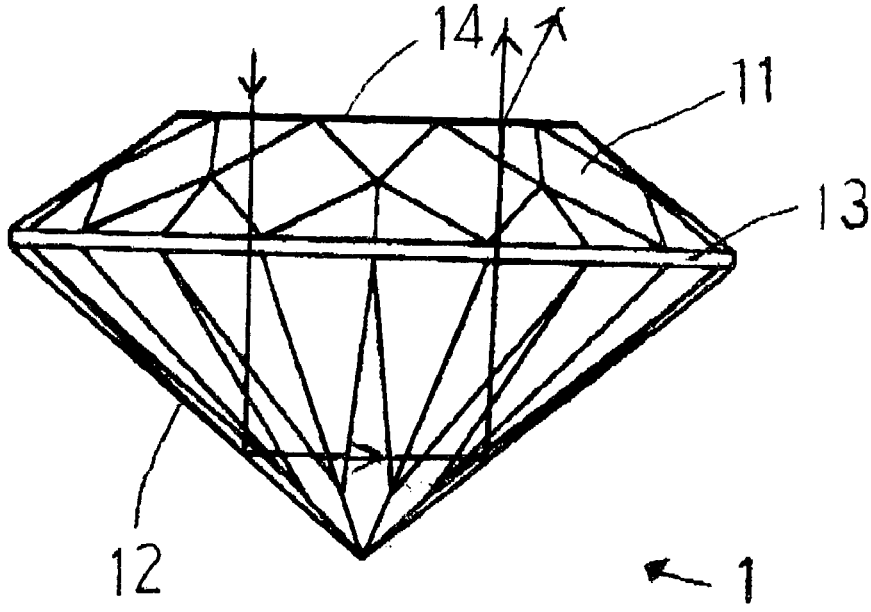
FIG. 1 is a front view for showing a diamond of a first embodiment of the present invention.
Figure 2:
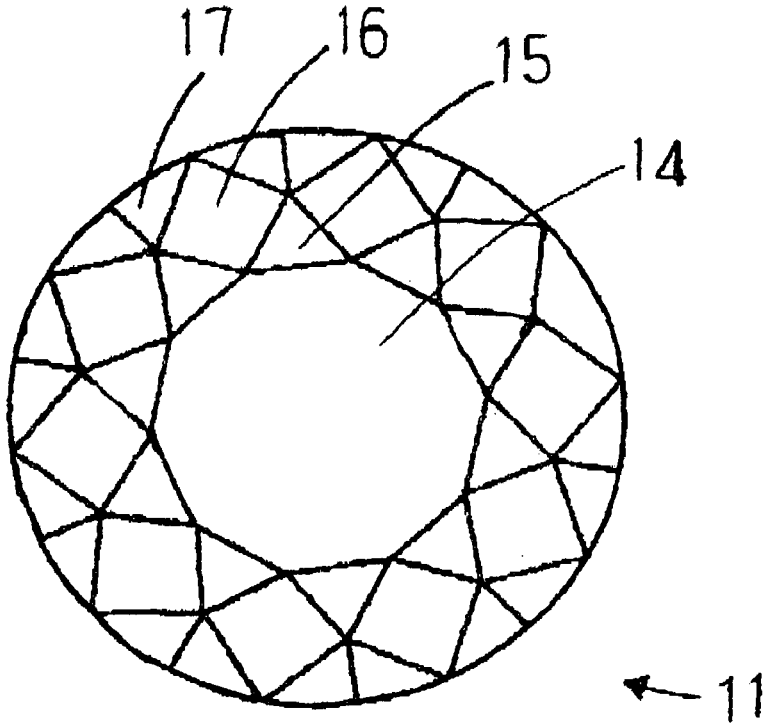
FIG. 2 is a plan view for showing the diamond viewed from a crown side of the first embodiment of the present invention.

Referring now to the drawings, preferred embodiments of the present invention are described more particularly. FIG. 1 is a front view for showing a diamond of a first embodiment of the present invention. FIG. 2 is a plan view for showing the diamond viewed from a crown side of the first embodiment of the present invention. And FIG. 3 is a plan view for showing the diamond viewed from a pavilion side of the first embodiment of the present invention.

A diamond 1 has a generally trapezoidal conic crown 11 (generally trapezoidal in cross section), a generally conic pavilion 12 (generally triangle in cross section), and a strip-like girdle provided on the lateral surface along the boundary of the crown 11 and the pavilion 12 as shown in FIG. 1.

A flat table 14 is formed in the center of the crown 11 of the diamond 1 as shown in FIG. 2. Ten of star facets 15 are formed around the table 14. And generally rhombic crown main facets 16 (usually called 'bezel facet') are formed encircling the star facets 15. Further, twenty of upper girdle facets 17 are formed in contact with outer sides of the crown main facets 16.

Figure 3:
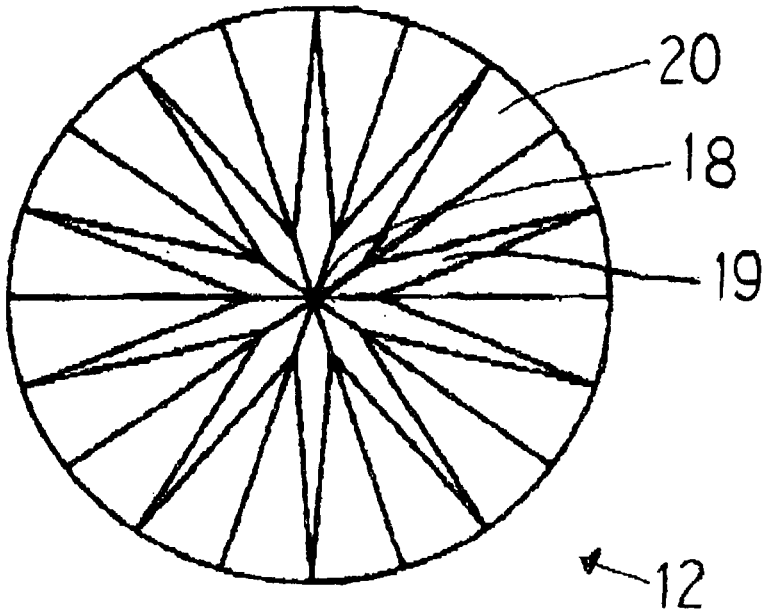
FIG. 3 is a plan view for showing the diamond viewed from a pavilion side of the first embodiment of the present invention.

Ten of pavilion main facets 19 radiating from an acute curette 18 are formed in the pavilion 12 of the diamond 1 as shown in FIG. 3, And twenty of lower girdle facets are formed between adjacent pavilion main facets.

Figure 4:
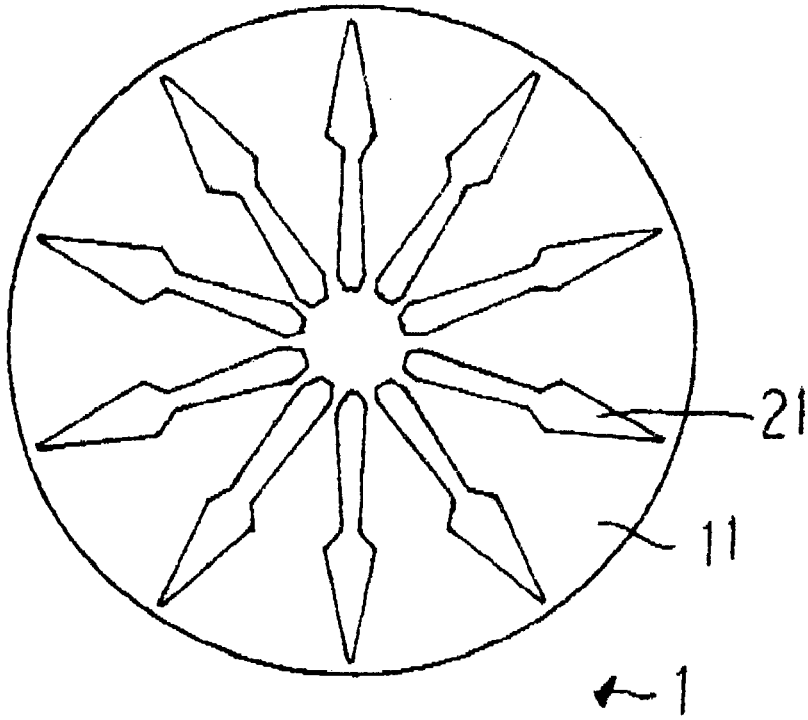
FIG. 4 is a plan view for showing allow phenomenon in the diamond of the first embodiment of the present invention.
Figure 5:
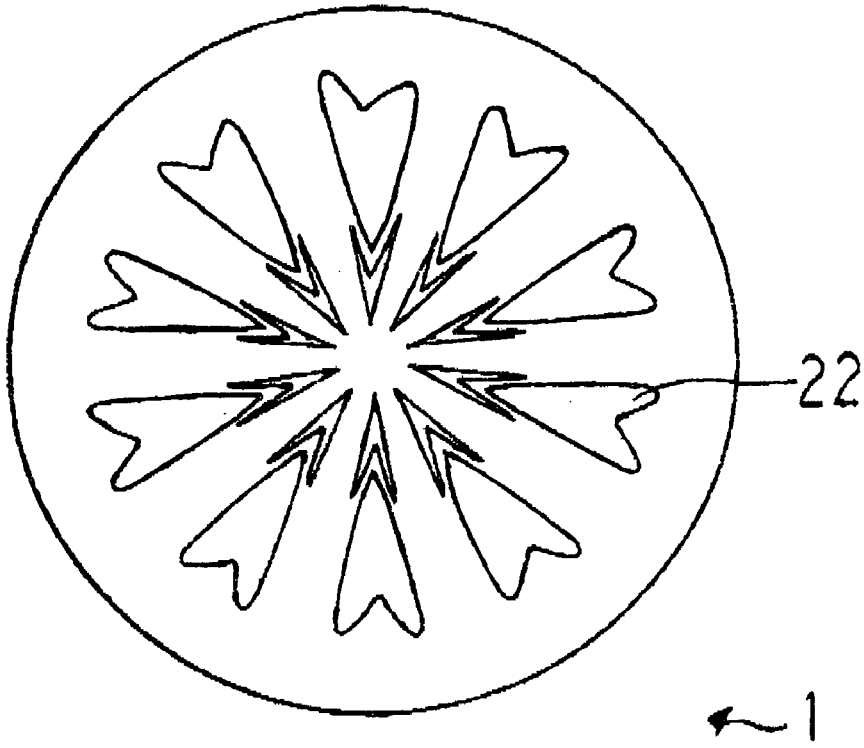
FIG. 5 is a plan view for showing heart phenomenon in the diamond of the first embodiment of the present invention, FIGS. 6(*a*) through 6(*d*) are drawings for illustrating steps of a method of cutting diamond of the first embodiment of the present invention on the pavilion side, FIGS. 7(*a*) through 7(*d*) are drawings for illustrating steps of the method of cutting diamond of the first embodiment of the present invention on the crown side, FIGS. 8(*a*) and 8(*b*) are perspective views for showing a diamond in crystal form and the same in the state of being cut at its top edge.

Ten of heart and allow phenomenon are observed in the diamond 1 in an excellent proportion of the present invention. When the diamond 1 is mounted in a face-up direction (directing the table 14 upward), ten of heart and allow phenomenon 21 may be observed as shown in FIG. 4 and when the diamond 1 is mounted in a face-down direction (directing the table 14 downward), ten of heart and allow phenomenon 22 may be observed as shown in FIG. 5 by using a magnifying device on condition that one of the main facets is illuminated by light colored through a color filter while the remainder are shielded from incident light.

The diamond 1 of the present invention has ten of pavilion main facets 19. Brilliancy (reflection) of a diamond is created by the light (represented as an allow in FIG. 1) coming in through the crown 11 side, reflecting at the pavilion main facets 19, and going out through the crown 11 side as shown in FIG. 1. Therefore, the diamond 1 of the present invention providing more pavilion main facets 19 is capable of emitting brilliance stronger than conventional diamonds finished in round brilliant cut. Additionally, diffused light and sparkle are caused when reflection passes and refracted at the crown main facets 16. Therefore, the diamond 1 of the present invention providing more crown main facets 16 is capable of emitting brilliance stronger than conventional diamonds.

And in the diamond 1 of the present invention, ten of crown main facets 16 and ten of pavilion main facets 19 are formed as mentioned above and therefore ten heart and allow phenomenon which is more than conventional diamond in round brilliant cut may be observed. The number of ten has been thought to have meanings of 'perfection' or 'development' from of old in Europe and America, which is an important selling point for an ornamental piece. Thus, value of the diamond is enhanced by embodying ten of hearts and allows.

Figure 6:
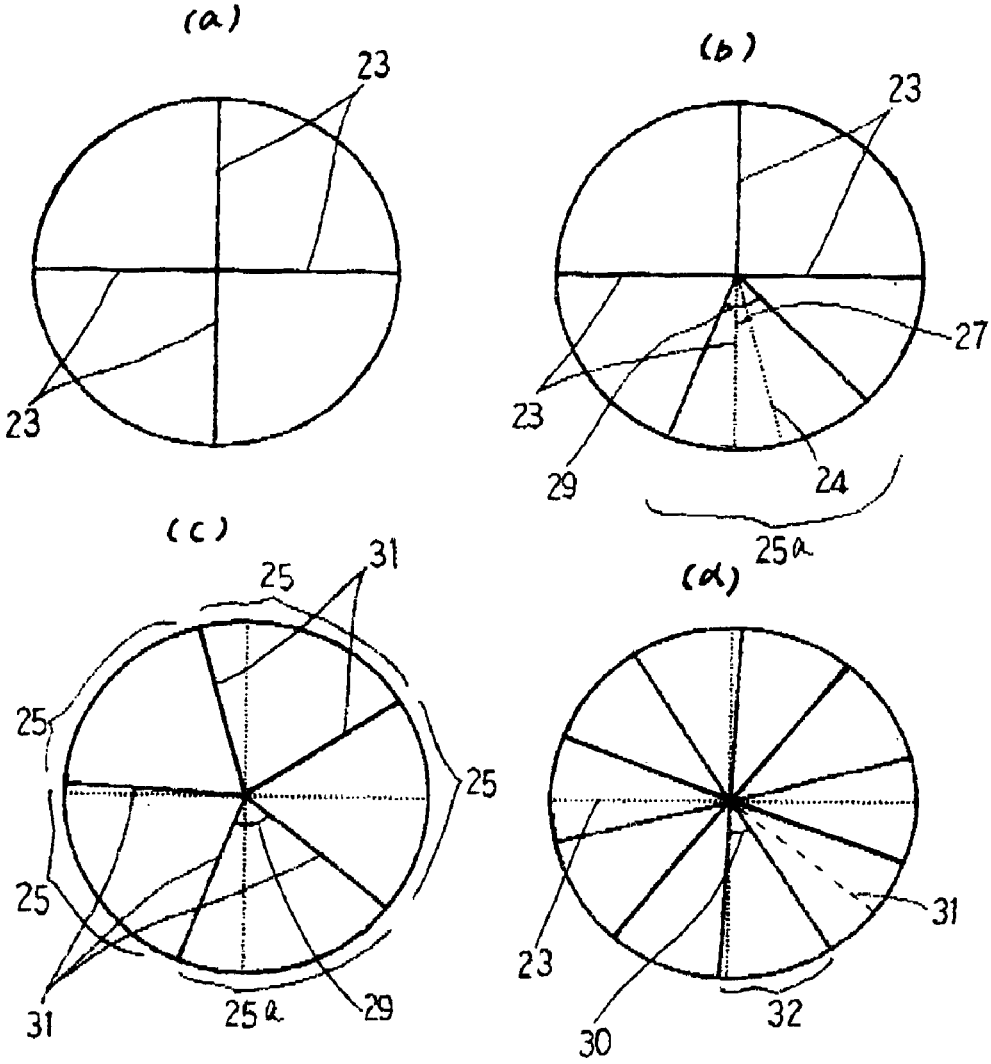
Figure 8:
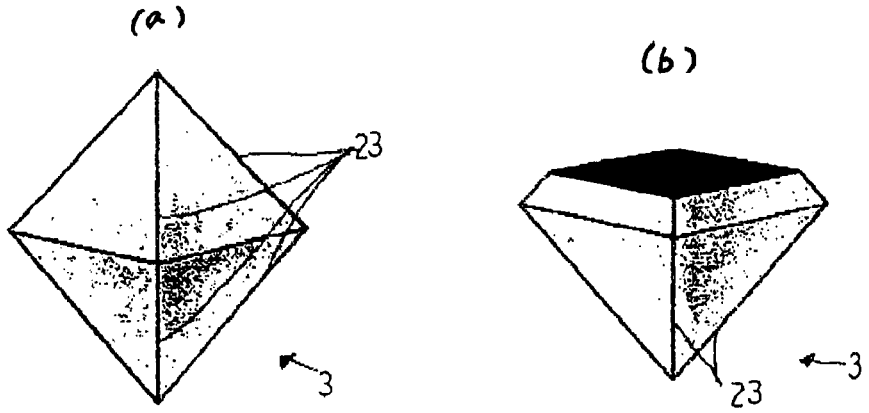
Figure 9:
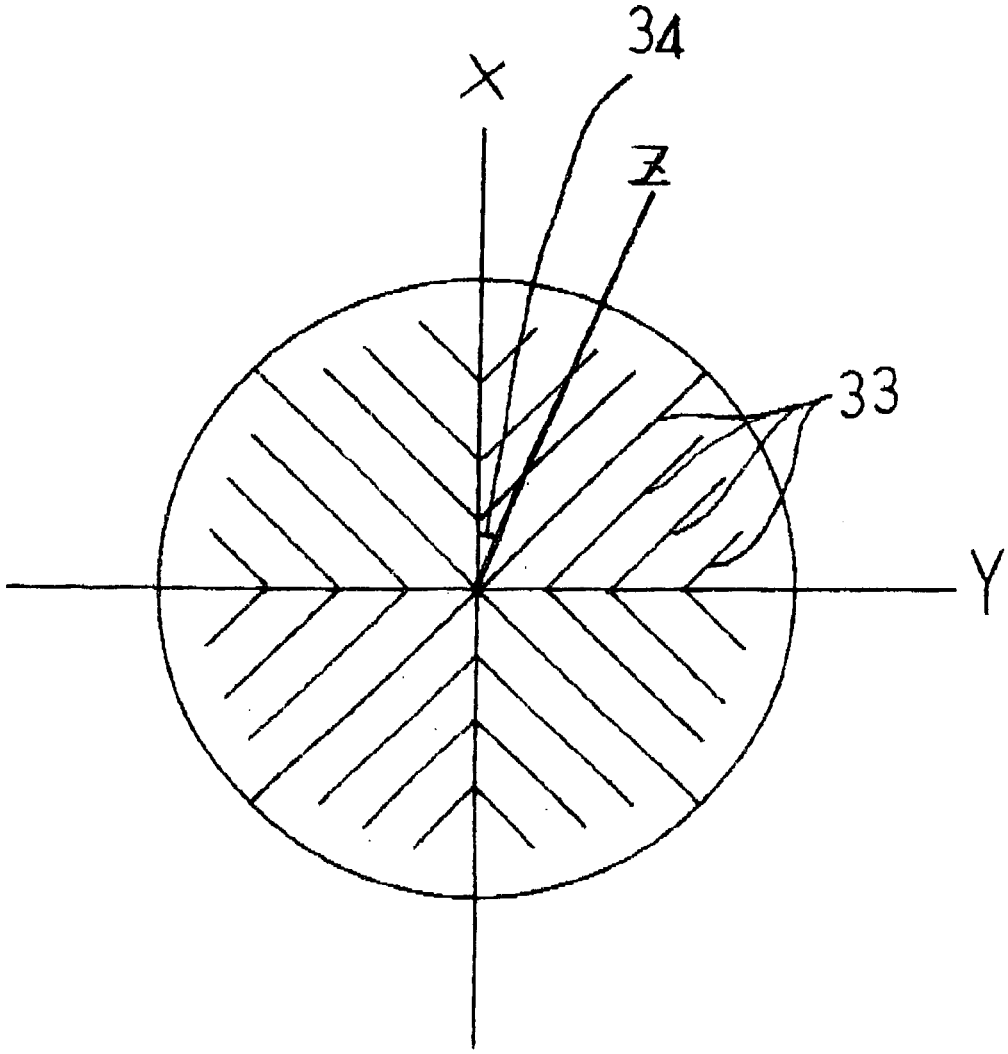
FIG. 9 is a drawing for showing growth lines of the diamond in crystal form.

Next, the method of cutting diamond of the present invention is described. FIGS. 6(*a*) through 6(*d*) are drawings for illustrating an embodiment of the method of cutting the diamond of the present invention on the pavilion side and FIGS. 7(*a*) through 7(*d*) are drawings for illustrating an embodiment of the method of cutting the diamond of the present invention on the crown side. FIGS. 8(*a*) and 8(*b*) are perspective views for showing a diamond in crystal form and the same in the state of being cut at its top edge. And FIG. 9 is a drawing for showing growth lines of the diamond in crystal form.

In the event of polishing surfaces on the pavilion side, a first pavilion main facet 25*a* is formed initially on a center line 24 shifted approximately fifteen degrees 27 from a ridge 23 formed on the pavilion side of a raw diamond 3 in crystal form (FIG. 6(*b*)) and the remaining first pavilion main facets 25 are formed subsequently (FIG. 6(*c*)) as a first step. In the above-mentioned event, five of first pavilion main facets are formed in total and therefore the central angle 29 of each first pavilion main facet becomes seventy-two degrees. And ten of second pavilion main facets 32 providing central angles 30 at thirty-six degrees are formed in positions centered on boundary lines 31 between adjacent first pavilion main facets 25 as a second step.

In the method of the present invention, the point of applying the polishing process on the position centered on the center line 24 shifted approximately fifteen degrees from the ridge 23 of the diamond in crystal form relates to growth lines in the raw diamond 3 in crystal form. A diamond has ridges X, Y and growth lines 33 as shown in FIG. 9. In the event of dividing both of ridges X and Y into four parts by the growth lines 33, a position on a line Z (a line shifted from the ridge X at an angle 34 of twenty-two point five degrees) is the most difficult portion to polish flat. Therefore, in the steps of forming the first pavilion main facets 25 and the second pavilion main facets 32, the center lines of the above-mentioned facets are preferably kept from overlapping with the line Z or the facets are hardly formed flat and hardly polished properly.

In a conventional round brilliant cut, four of first pavilion main facets are formed in the positions centered on four ridges of the raw diamond 3 as a first step. Thereafter, the second pavilion main facets are formed in the positions centered on the boundary lines between adjacent first pavilion main facets. Thus, the line Z kept from overlapping with the center lines of the facets and eight of second pavilion main facets are formed properly.

However, in the event of forming ten of the pavilion main facets by the conventional method, one or more of the center lines of the pavilion main facet overlap with the line Z. Accordingly, the center line of the initial first pavilion main facet 25 is shifted from the ridge 23 at an angle 27 of approximately fifteen degrees in the first step in order to process all the pavilion main facets properly.

Figure 7:
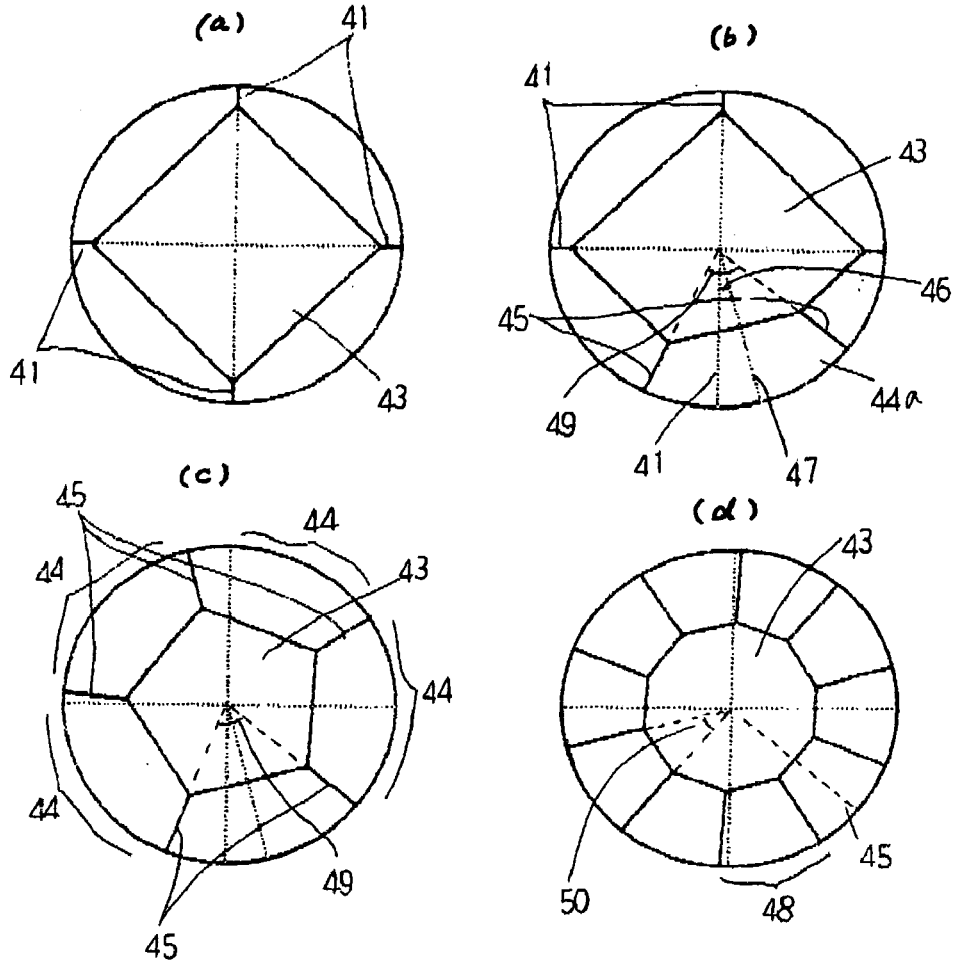

And FIGS. 7(*a*) through 7(*d*) are drawings for illustrating an embodiment of the method of cutting the diamond of the present invention on the crown side.

In the event of processing the crown side, a flat table 3 is formed after an edge portion of the diamond in crystal form is cut off as shown in FIG. 8 (*b*). And an initial first crown main facet 44*a* is formed (FIG. (*b*)) in position centered on a line 47 shifted approximately fifteen degrees from a ridge 41 of the diamond 3 in crystal form shown in FIG. 7(*a*) and the remaining first crown main facets 44 are formed subsequently (FIG. 7(*c*)) as a first step. In the above-mentioned event, five of the first crown main facets 44 are formed in total and one of central angles 49 formed between two adjacent boundary lines 45 which meet at the center becomes seventy-two degrees consequently. Thereafter, ten of second crown main facets 48 are formed by polishing the positions centered on the boundary lines 45 between the adjacent first crown main facets 44 as a second step. The central angle 50 in the above-mentioned step becomes thirty-six degrees.

The polishing process characterized in providing a standard line 24 shifted approximately fifteen degrees from the ridge 23 of the diamond in crystal form is applied in a similar manner to the above-mentioned cutting method of forming the pavilion facets in the diamond of the present invention and is ascribable to the position of the growth lines in the raw diamond in crystal form.

Additionally, after forming the pavilion main facets and the crown main facets, narrower surfaces of lower girdle facets, star facets and upper girdle facets are formed with reference thereto.

Figure 10:
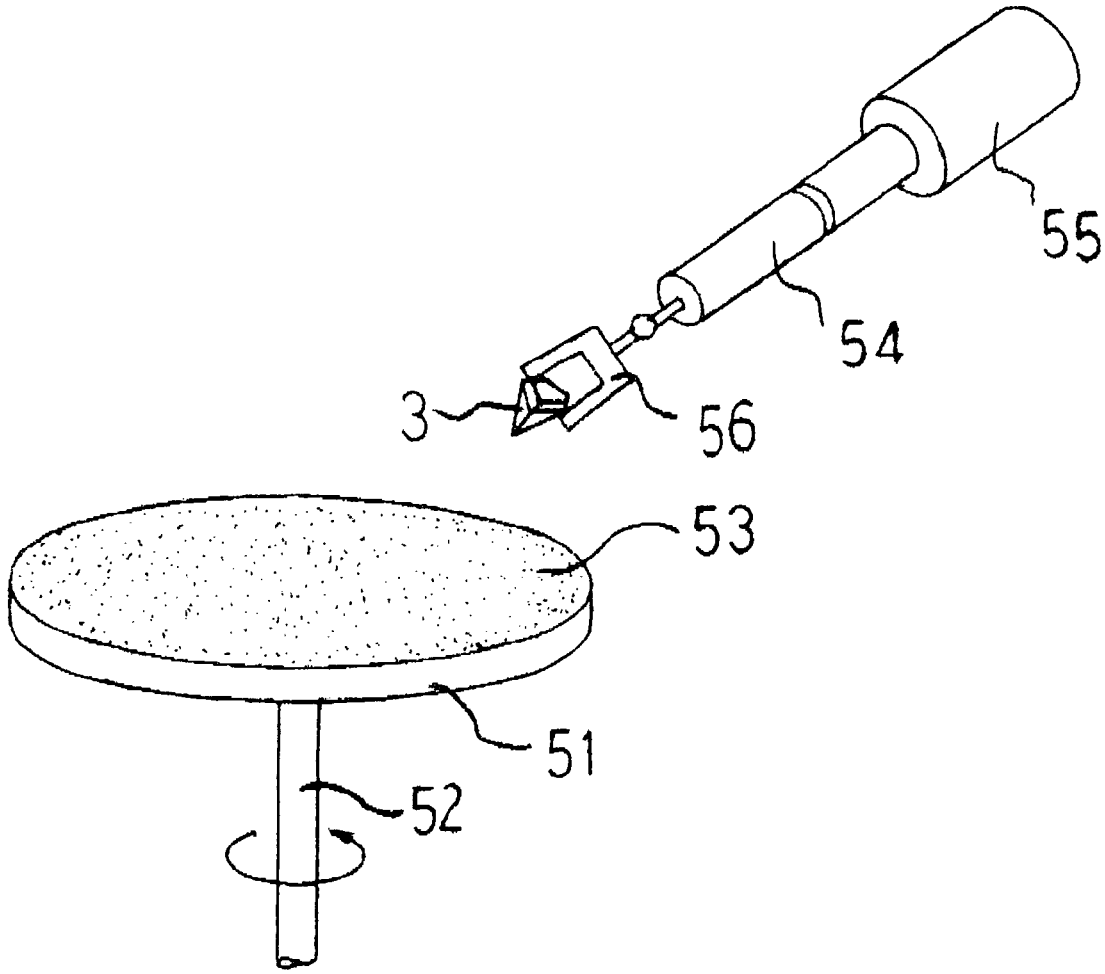
FIG. 10 is a drawing for showing a device used in the method of cutting diamond of the first embodiment of the present invention.
Figure 11:
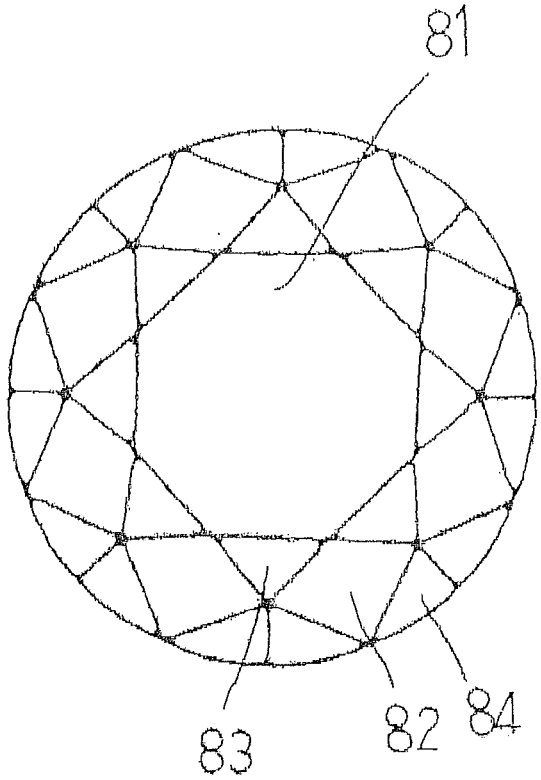
Fig. 11 (PRIOR ART)
FIG. 11 is a plan view for showing a conventional diamond viewed from the crown side.
Figure 12:
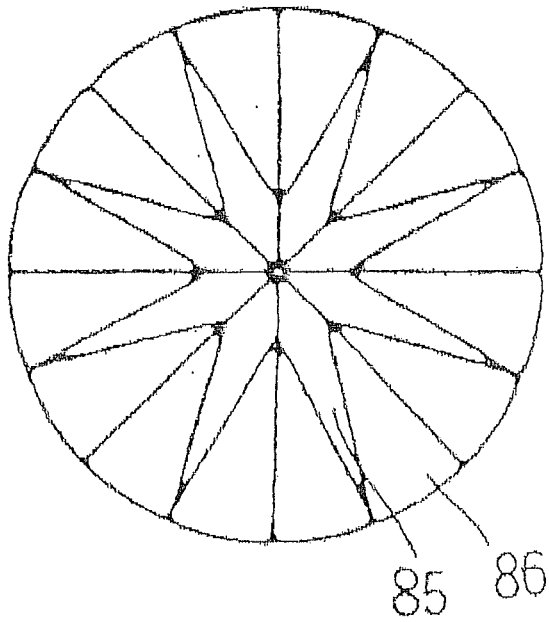
Fig. 12 (PRIOR ART)
FIG. 12 is a plan view for showing a conventional diamond viewed from the pavilion side, FIGS. 13(*a*) through 13(*d*) are drawings for illustrating steps of a method of cutting the conventional diamond, FIGS. 13(*a*) through 13(*d*) are drawings for illustrating steps of the method of cutting the conventional diamond on the pavilion side, FIGS. 14(*a*) through 14(*d*) are drawings for illustrating steps of the method of cutting the conventional diamond on the crown side.
Figure 13:
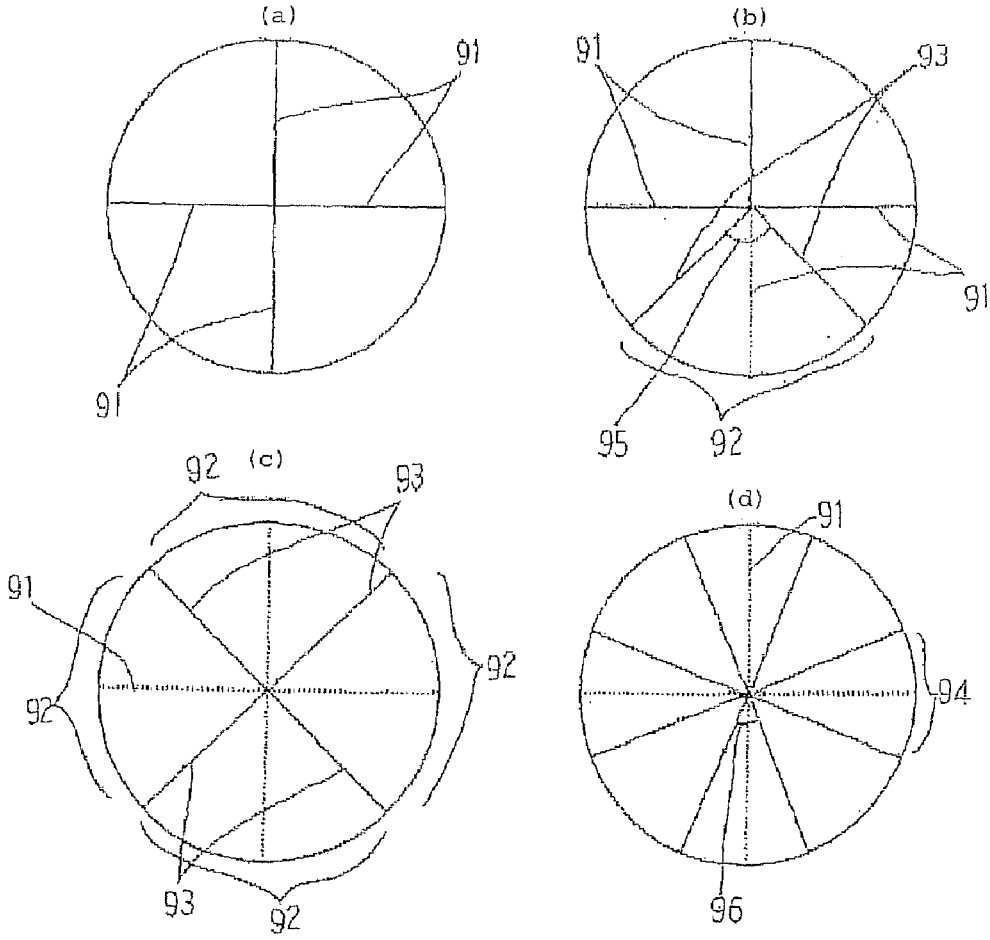
Fig. 13 (PRIOR ART)
Figure 14:
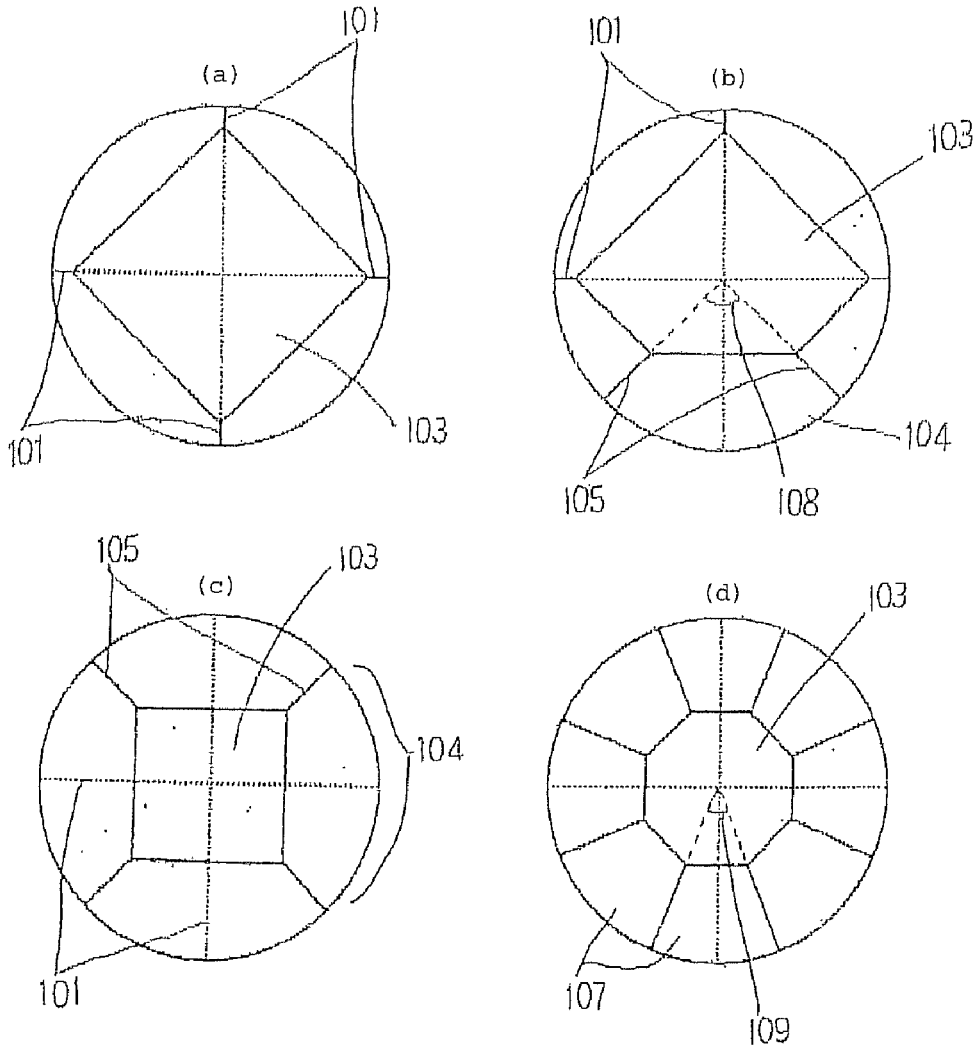
Fig. 14 (PRIOR ART)
Figure 15:
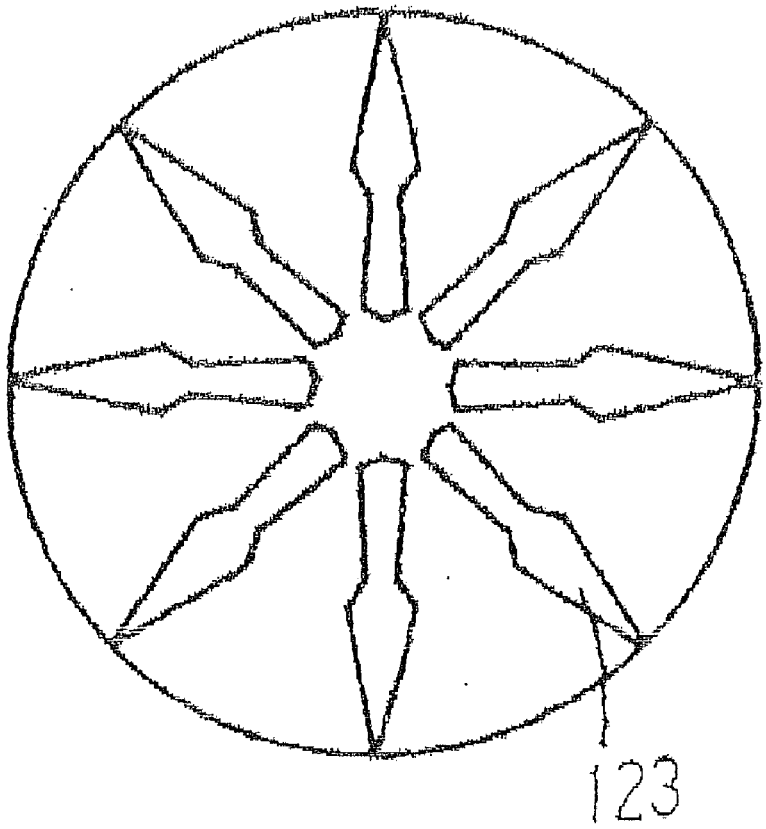
Fig. 15 (PRIOR ART)
FIG. 15 is a plan view for showing the allow phenomenon in the conventional diamond.
Figure 16:
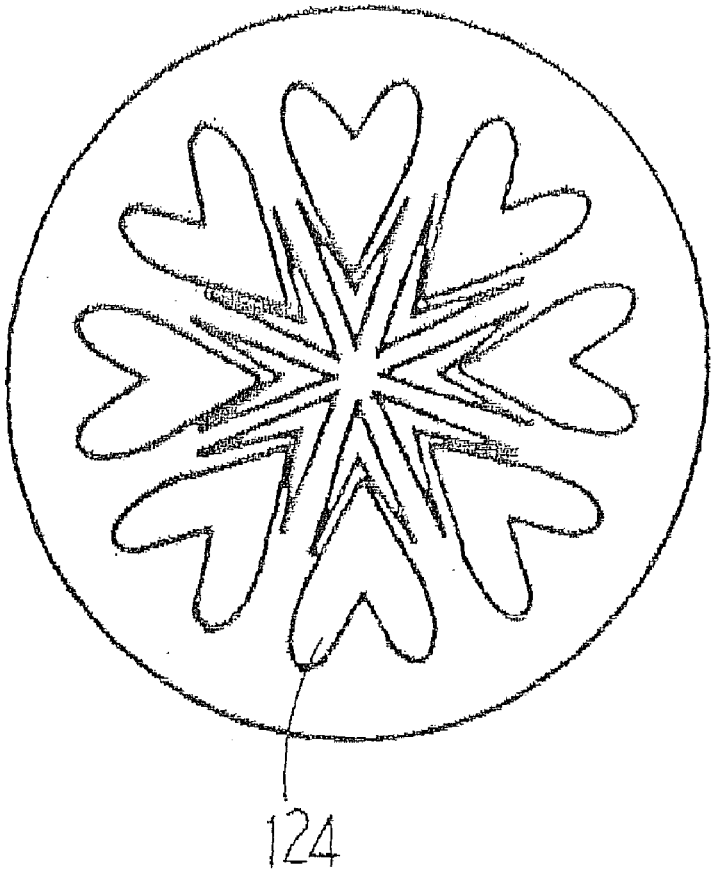
Fig. 16 (PRIOR ART)
FIG. 16 is a plan view for showing the heart phenomenon in the conventional diamond.

A device shown in FIG. 10 is used for applying the polishing process for forming facets to the diamond. A numeral 51 indicates a base usually called scaif is used in the polishing process. The scaif 51 is rotatably held by a shaft 52. And an upper surface of the scaif 51 is coated with diamond powder 53 as polishing powder by using oil and the like.

Rotational frequency (speed) of the shaft 52 is controlled by a rotation control portion which is not shown in the drawing. A control portion 55 is provided above the scaif 51 and a holding shaft having a holding portion 56 which is usually called tang 54 for holding the raw diamond 3 is provided as an edge of the control portion 55.

The control portion 55 comprising a movable lifting means not shown in the drawings controls descent and ascent of the shaft to start and to stop applying the polishing process to the raw diamond 3. Additionally, the control portion 55 controls the angle, the length of processing time and polishing pressure of the tang 54 in order to form facets on the diamond. Incidentally, the device is capable of applying the polishing process to the raw diamond 3 with the tang holding the diamond 3 changing the angle at thirty-six degrees.

In the polishing device having the above-mentioned construction, the scaif 51 is rotated by the shaft 52 at a predetermined rotational frequency, the raw diamond 3 is held by the tang 54 at its crown side, the holding shaft is controlled to descend by the control portion 55, and thereafter the pavilion side of the diamond is polished in contact with the scaif 51. In the above-mentioned event, the angle of the tang 54 shifted at approximately thirty-six degrees and the length of time and the pressure of polishing are controlled by the control portion 55. And the initial first main facet 25*a* is formed by polishing a position centered on a line 24 shifted approximately fifteen degrees from the ridge 23 of the raw diamond in crystal form and the remainder of the first main facets 25 are formed subsequently, which totals five of first pavilion main facets. Thereafter, ten of second pavilion main facets 32 centered on the boundary lines 31 between the adjacent first main facets 25 are formed.

The method of polishing the crown main facets on the diamond of the present invention is performed in a generally similar manner to the above-mentioned method of polishing the pavilion main facets.

Further, after forming the pavilion main facets and the crown main facets are formed, lower girdle facets, star facets and upper girdle facets that are narrower in width are formed in a generally similar manner to the conventional method of cutting a diamond.

Incidentally, including the above-mentioned steps in the method of cutting diamond usually called blocking, other steps of marking, sawing, bruting, table polishing and the like are performed in the similar manner to the conventional cutting process.

Too many pavilion main facets and crown main facets cause difficulty in observing the heart and allow phenomenon as the proof of excellence in cutting and brilliance by the unaided eye, even though the facets are effective to emit stronger brilliance. Therefore, the number of the pavilion main facets and of the heart and allow phenomenon is preferably around ten. And in the process of polishing the first main facet, the angle of the center line shifted from the ridge 23 of the raw diamond 3 in crystal form is preferably fifteen degrees as mentioned above. However, any angle is possible within limits acceptable in the polishing process.

Thus, as the diamond obtained by the methods of the present invention has ten of pavilion main facets and ten of crown main facets, the incident light is reflected more brightly in the pavilion, refracted in the crown and sent out. Accordingly, more heart and allow phenomenon that is a proof of excellent cutting and brilliance may be observed by the unaided eye, and the above-mentioned diamond can emit brilliance stronger than the conventional diamond.

Further, with the method of cutting diamond of the present invention, a diamond providing ten of pavilion main facets and ten of crown main facets may be obtained easily and accurately.

And those skilled in the art will recognize that the invention can be practiced with modification within the spirit and scope of the appended claims. A diamond is named as an example in the above-mentioned embodiment and the present invention may be applied to other jewels.

As it has been described as above, the present invention is characterized in forming the initial first main facet in the position centered on the line shifted approximately fifteen degrees from the ridge of the raw diamond in crystal form and five of the first main facets in total, and in forming ten of second main facets referring to the boundary lines between the adjacent first main facets. And the above-mentioned main facets are formed on both of the crown and the pavilion sides easily and accurately. Therefore, the present invention can provide a diamond capable of embodying more heart and allow phenomenon that is a proof of excellent cutting and brilliance as far as it may be observed by the unaided eye, thereby emitting stronger brilliance.

[Reference Numerals]

| | |
|---|---|
| 1: diamond | 3: row diamond |
| 11: crown | 12: pavilion |
| 13: girdle | 14: table |
| 15, 83: star facet | 16, 82: crown main facet |
| 17, 84: upper girdle facet | 18: curette |
| 19, 85: pavilion main facet | 20, 86: lower girdle facet |
| 21, 123: allow phenomenon | 22, 124: heart phenomenon |
| 23, 91: ridge | 24: center line |
| 25: first main facet | 27: angle |
| 29, 30, 34, 49, 50, 95: central angle | 31, 45, 93: boundary line |
| 32: second pavilion main facet | 33: growth line |
| 43, 81: table | 44: first crown main facet |
| 47: center line | 48: second crown main facet |
| 51: scaif | 52: rotating shaft |
| 53: diamond powder | 54: tang |
| 55: control portion | 56: holding portion |
| 92: first pavilion main facet | 94: second pavilion main facet |

What is claimed is:

1. A method of cutting diamond for providing a diamond with a generally trapezoidal conic crown having a flat table on top, a generally conic pavilion having an acute curette at the center, and a strip-like girdle provided on the lateral surface along the boundary of said crown and said pavilion comprising:

a first step of forming an initial first pavilion main facet centered on a line shifted approximately fifteen degrees from a ridge formed on the pavilion side of a raw diamond in crystal form and the remaining first pavilion main faces subsequently, which totals five of first pavilion main facets, and a second step of forming ten of second pavilion main facets centered on the boundary lines between said first pavilion main facets.

2. A method of cutting diamond for providing a diamond with a generally trapezoidal conic crown having a flat table on top, a generally conic pavilion having an acute curette at the center, and a strip-like girdle provided on the lateral surface along the boundary of said crown and said pavilion comprising:

a first step of forming an initial first crown main facet centered on a line shifted approximately fifteen degrees from a ridge formed on the crown side of a raw diamond in crystal form and the remaining first crown main faces subsequently, which totals five of first crown main facets, and a second step of forming ten of second crown main facets centered on the boundary lines between said first crown main facets.

3. A method of cutting diamond as claimed in claim 1, further comprising the step of:

using a device providing means for using a tang for changing the direction of said raw diamond held therein at a predetermined angle and means for applying a polishing process to said raw diamond by rotating the scaif in the steps of forming said first and said second pavilion main facets, in which said device applies a polishing process to said raw diamond by changing the direction of said raw diamond held therein at an angle of thirty-six degrees.

4. A diamond obtained by the cutting method as claimed in claim 1.

5. A diamond obtained by the cutting method as claimed in claim 1, comprising:

ten of pavilion main facets radiating from said curette and twenty of lower girdle facets formed between adjacent pavilion main facets are formed respectively on said pavilion side.

6. A diamond obtained by the cutting method as claimed in claim 2, comprising:

ten of star facets encircling said table, ten of crown main facets encircling said star facets, and twenty of upper girdle facets encircling said crown main facets are formed on said crown side.

7. A diamond obtained by the cutting method as claimed in claim 1, wherein a projection of ten heart shapes are observed when said diamond is mounted in face-down direction under a predetermined lighting condition.

8. A diamond obtained by the cutting method as claimed in claim 1, wherein a projection of ten allow shapes are observed when said diamond is mounted in face-up direction under the predetermined lighting condition.

9. A method of cutting diamond according to claim 2, further comprising the step of:

using a device providing means for using a tang for changing the direction of said raw diamond held therein at a predetermined angle and means for applying a polishing process to said raw diamond by rotating the scaif in the steps of forming said first and said second crown main facets, in which said device applies a polishing process to said raw diamond by changing the direction of said raw diamond held therein at an angle of thirty-six degrees.

10. A diamond obtained by the cutting method according to claim 2.

11. A diamond obtained by the cutting method according to claim 3.

12. A diamond obtained by the cutting method according to claim 2, wherein a projection of ten heart shapes are observed when said diamond is mounted in face-down direction under a predetermined lighting condition.

13. A diamond obtained by the cutting method according to claim 3, wherein a projection of ten heart shapes are observed when said diamond is mounted in face-down direction under a predetermined lighting condition.

14. A diamond obtained by the cutting method according to claim 5, wherein a projection of ten heart shapes are observed when said diamond is mounted in face-down direction under a predetermined lighting condition.

15. A diamond obtained by the cutting method according to claim 6, wherein a projection of ten heart shapes are observed when said diamond is mounted in face-down direction under a predetermined lighting condition.

16. A diamond obtained by the cutting method according to claim 2, wherein a projection of ten allow shapes are observed when said diamond is mounted in face-up direction under the predetermined lighting condition.

17. A diamond obtained by the cutting method as claimed in claim 3, wherein a projection of ten allow shapes are observed when said diamond is mounted in face-up direction under the predetermined lighting condition.

18. A diamond obtained by the cutting method according to claim 5, wherein a projection of ten allow shapes are observed when said diamond is mounted in face-up direction under the predetermined lighting condition.

19. A diamond obtained by the cutting method according to claim 6, wherein a projection of ten allow shapes are observed when said diamond is mounted in face-up direction under the predetermined lighting condition.

* * * * *